US006783103B2

(12) United States Patent
Salani

(10) Patent No.: US 6,783,103 B2
(45) Date of Patent: Aug. 31, 2004

(54) DEVICE FOR SUPPORTING OBJECTS ON A SUPPORT STRUCTURE

(75) Inventor: Theodore R. Salani, 7721 Dalewood Pkwy., Woodridge, IL (US) 60517

(73) Assignee: Theodore R. Salani, Woodridge, IL (US)

( * ) Notice: Subject to any disclaimer, the term of this patent is extended or adjusted under 35 U.S.C. 154(b) by 0 days.

(21) Appl. No.: 10/209,212

(22) Filed: Jul. 30, 2002

(65) Prior Publication Data

US 2003/0052242 A1 Mar. 20, 2003

Related U.S. Application Data

(60) Provisional application No. 60/308,735, filed on Jul. 30, 2001, and provisional application No. 60/311,630, filed on Aug. 10, 2001.

(51) Int. Cl.[7] ..... E06C 7/14

(52) U.S. Cl. ..... 248/211; 248/210; 248/311.2

(58) Field of Search ..... 248/211, 210, 248/238, 311.2, 215; 15/257.06; 182/129

(56) References Cited

U.S. PATENT DOCUMENTS

| | | | | |
|---|---|---|---|---|
| 2,524,875 A | | 10/1950 | Beaver | |
| 2,911,016 A | | 11/1959 | Kenney | |
| 2,920,853 A | * | 1/1960 | Bufogle | 248/214 |
| 3,108,776 A | | 10/1963 | Cook | |
| 3,160,383 A | * | 12/1964 | Lamm | 248/211 |
| 3,278,148 A | | 10/1966 | Denaro | |
| 3,312,441 A | | 4/1967 | Molenda | |
| 3,414,311 A | | 12/1968 | Trimboli | |
| 3,448,956 A | | 6/1969 | Kuhaneck, Jr. | |
| 3,462,109 A | | 8/1969 | Forbes | |
| 3,707,242 A | | 12/1972 | Golden et al. | |
| 3,738,601 A | | 6/1973 | Gehringer | |
| 3,863,883 A | * | 2/1975 | Cousins | 248/477 |
| 3,895,772 A | * | 7/1975 | Ellingson | 248/210 |
| 3,940,824 A | | 3/1976 | Gioia et al. | |
| 3,980,264 A | | 9/1976 | Tomasik | |
| 4,053,131 A | * | 10/1977 | Francis | 248/211 |
| 4,071,214 A | | 1/1978 | Reidy | |
| 4,205,411 A | | 6/1980 | Cupp et al. | |
| 4,433,822 A | | 2/1984 | Caggiano | |
| D291,168 S | | 8/1987 | Cranford | |
| 4,702,446 A | | 10/1987 | Brown | |
| 4,787,586 A | * | 11/1988 | Crain | 248/210 |
| 4,890,807 A | | 1/1990 | Desjardins | |
| 4,899,970 A | * | 2/1990 | Berzina | 248/210 |
| 5,016,773 A | | 5/1991 | Lockwood | |
| 5,031,723 A | | 7/1991 | Hooten | |

(List continued on next page.)

FOREIGN PATENT DOCUMENTS

DE 87 12 533 U1 A1 2/1988

OTHER PUBLICATIONS

International Search Report for PCT/US02/24066 dated Apr. 2, 2003.

Schonhoff, German Patent No. DE 87 12 533 U1, drawing Fig. 1.

Schonhoff, German Patent No. DE 87 12 533 U1, drawing Fig. 2.

*Primary Examiner*—Leslie A. Braun
*Assistant Examiner*—Amy J Sterling
(74) *Attorney, Agent, or Firm*—Marshall, Gerstein & Borun LLP

(57) ABSTRACT

A device for supporting a container having a wire handle and a sidewall on a support structure is disclosed. The device includes a pair of spaced apart side members, with each of the side members having an upper portion adapted to engage the support structure and a notch sized to receive the wire handle. A central portion of the device is disposed between the side members, with the central portion defining a receiving area sized and shaped to receive the container such that the receiving area engages only the sidewall of the container.

22 Claims, 15 Drawing Sheets

U.S. PATENT DOCUMENTS 5,062,607 A 11/1991 Kisner
5,079,795 A 1/1992 Schmid
5,482,339 A * 1/1996 Chishko, Jr. ..... 294/27.1
5,493,751 A 2/1996 Misiukowiec et al.
5,584,520 A * 12/1996 Niemeier ..... 294/34
5,716,034 A * 2/1998 Unkefer ..... 248/211
5,778,489 A * 7/1998 Marshal, II ..... 16/425
5,842,253 A 12/1998 Ahl et al.
6,027,152 A * 2/2000 Sawdey ..... 294/27.1
6,105,911 A 8/2000 Olexson
6,474,607 B1 * 11/2002 Wilson ..... 248/211

* cited by examiner

DEVICE FOR SUPPORTING OBJECTS ON A SUPPORT STRUCTURE

This application claims priority from U.S. Provisional Applications Serial No. 60/308,735 filed Jul. 30, 2001, and Serial No. 60/311,630, filed Aug. 10, 2001.

FIELD OF THE INVENTION

The present invention relates generally to a device for securing a can, such as a paint can, to a support structure such as ladder, and method of forming such a device.

BACKGROUND OF THE INVENTION

Painters working on a ladder may find it desirable to secure a can of paint to the ladder. Once the can of paint is secured to the ladder, the painter can focus on the job at hand with two free hands without having to constantly hold or balance the paint can. Securement of the paint can also reduces or eliminates inadvertent spills.

The prior art includes a number of examples of devices for securing paint cans to ladders. Nevertheless, there exists a continuing need for improvements in such devices.

DETAILED DESCRIPTION OF THE DISCLOSED EMBODIMENT

The following description of the disclosed embodiment is not intended to limit the scope of the invention to the precise form or forms detailed herein. Instead, the following description is intended to be illustrative of the principles of the invention so that others may follow its teachings.

Figure 1:
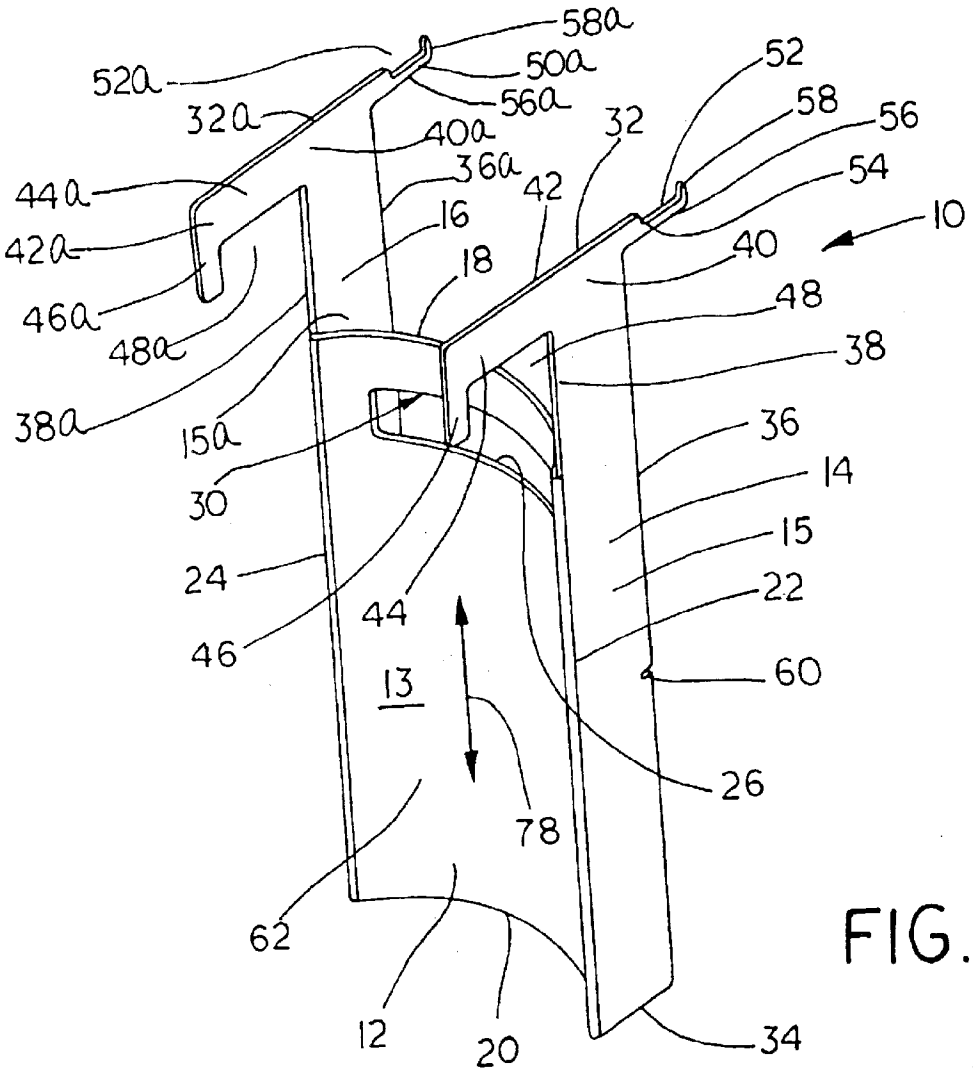
FIG. 1 is a perspective view of a can caddie assembled in accordance with the teachings of the present invention.
Figure 2:
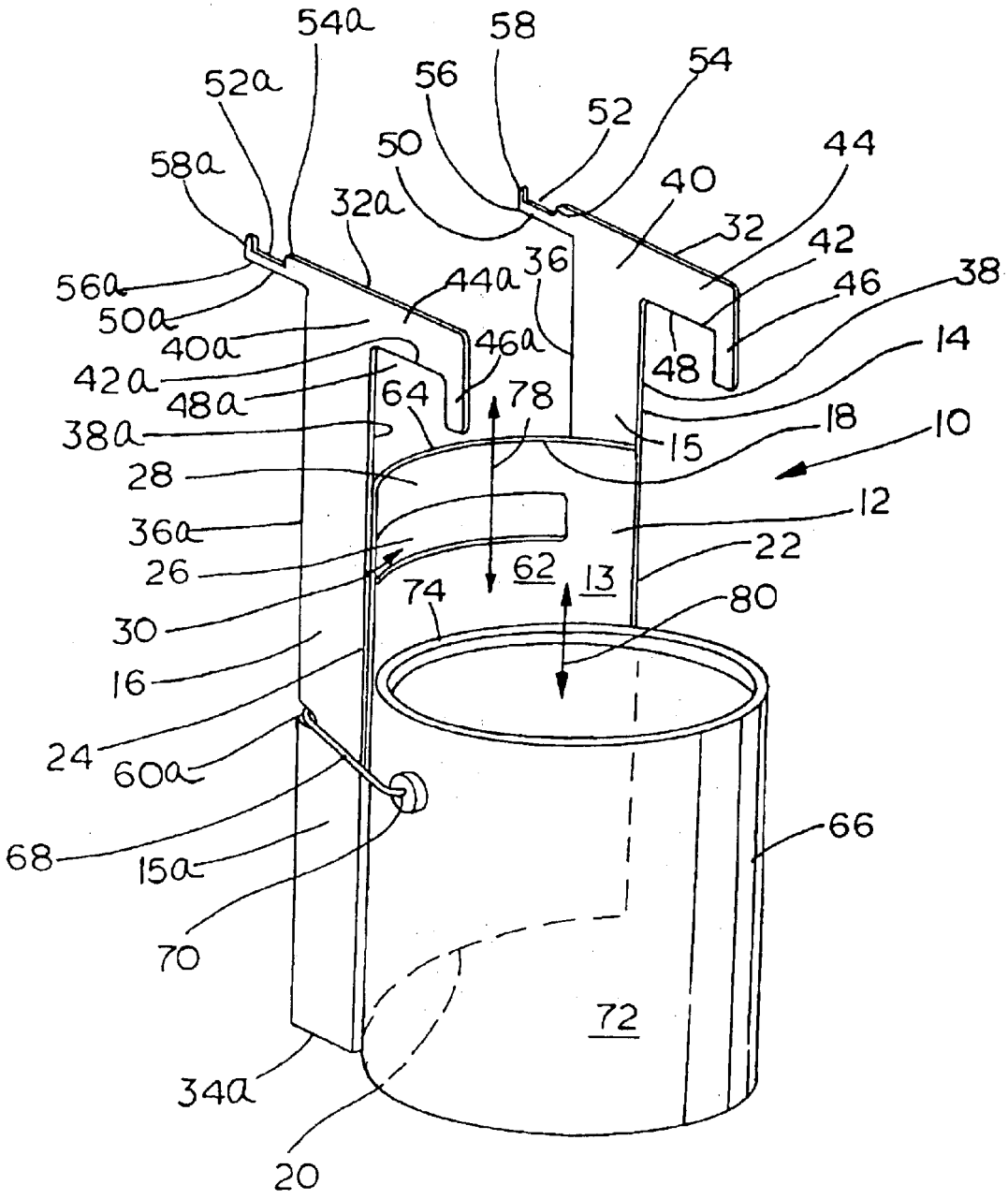
FIG. 2 is a front perspective view of the can caddie of FIG. 1 shown supporting a can.
Figure 3:
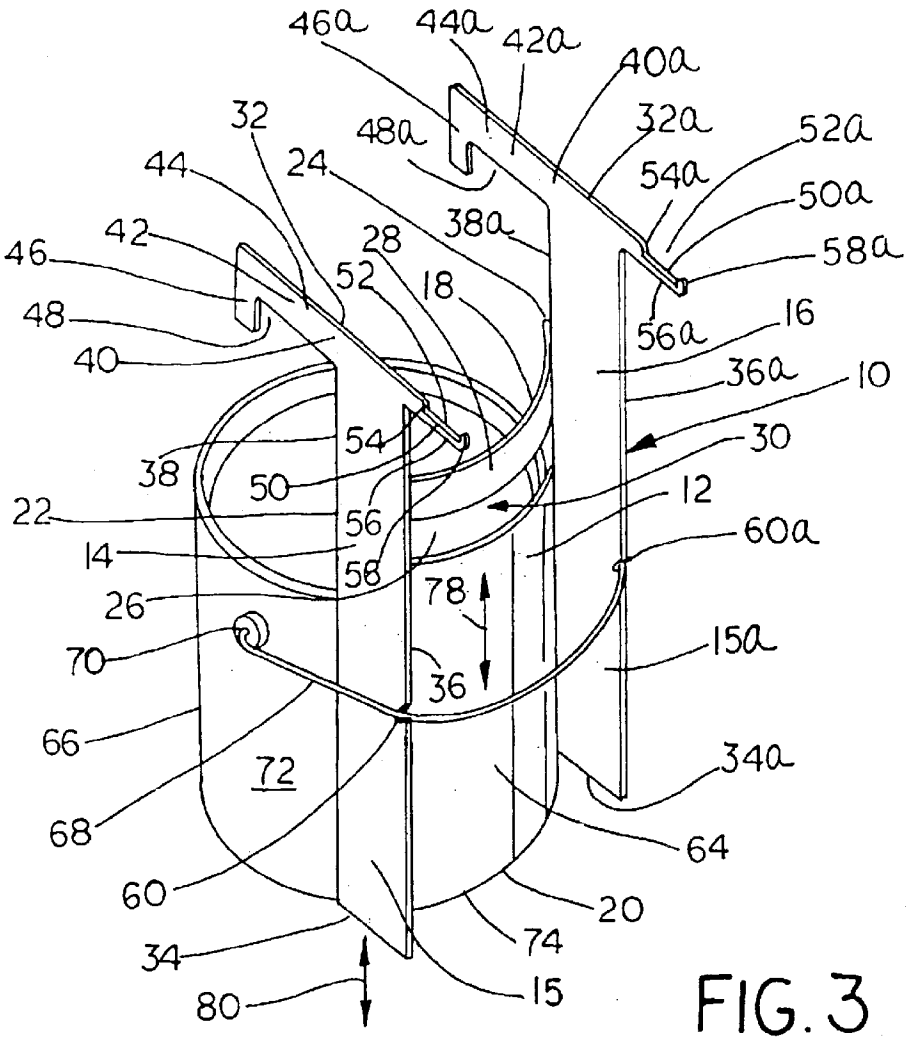
FIG. 3 is a rear perspective view of the can caddie and can shown in FIG. 2.

Referring now to FIGS. 1–3 of the drawings, a can caddie assembled in accordance with the teachings of the present invention is generally referred to by the reference numeral 10. The can caddie 10 includes a central section 12 and a pair of side members 14, 16. The central section 12 includes a top edge 18, a bottom edge 20, and is generally bounded by a pair of fold lines 22, 24. It will be noted that the side member 14 generally meets the central section 12 at the fold line 22, while the side members 16 generally meets the central section 12 along the fold line 24. The central section 12 also includes a cutout 26 which extends generally parallel to the top edge 18, and which is separated from the top edge 18 by a cross member 28, such that the cutout 26 and the cross member 28 cooperate to form a handle 30.

The side member 14 includes an upper edge 32, a lower edge 34 and a side edge 36, with the side edge 36 preferably extending generally parallel to the fold line 22. The side member 14 also includes a side edge 38 which extends generally parallel to the side edge 36, with the edge 38 generally extending upwardly from the fold line 22. Thus, the side edge 38 is generally parallel to and across from an upper portion of the side edge 36.

The side member 14 includes an upper portion 40. The upper portion 40 includes a first hook 42 defined by a pair of legs 44, 46. The legs 44, 46 and the edge 38 cooperate to define a receiving area 48. It will be noted that the receiving area 48 of the hook 42 faces in a generally downward direction when the can caddie 10 is oriented as shown. The upper portion 40 also includes a second hook 50 which generally extends from the side edge 36. The second hook 50 includes a receiving area 52 which is defined at least in part by an edge 54 and a pair of legs 56, 58. It will be noted that the receiving area 52 of the second hook 50 is oriented in a generally upward direction. The side edge 36 of the side member 14 includes an angled notch 60 (FIGS. 1 and 3).

In the disclosed example, the side member 14 forms a generally planar panel 15 while the side member 16 forms a generally planar panel 15*a*. The panel 15 is generally contiguous and runs between the pair of hooks 42, 50 in the upper portion 40 and the lower edge 34 at the bottom of the side member 14. The panel 15 is further bounded by the side edge 36, the side edge 38 and the fold line 22.

Similarly, the side member 16 includes an upper edge 32*a*, a lower edge 34*a*, and a side edge 36*a*, with the side edge 36*a* preferably extending generally parallel to the fold line 24. The side member 16 also includes a side edge 38*a* which extends generally parallel to the side edge 36*a*, with the side edge 38*a* generally extending upwardly from the fold line 24. Thus, the side edge 38*a* is generally parallel to and across from an upper portion of the side edge 36*a*.

The side member 16 includes an upper portion 40*a*. The upper portion 40*a* includes a first hook 42*a* defined by a pair of legs 44*a*, 46*a*. The legs 44*a*, 46*a* and the side edge 38*a* cooperate to define a receiving area 48*a*. It will be noted that the receiving area 48*a* of the hook 42*a* faces in a generally downward direction when the can caddie 10 is oriented as shown, and the receiving area 48*a* is oriented in the same general direction as the receiving area 48 of the first hook 42 on the side member 14.

Figure 3A:
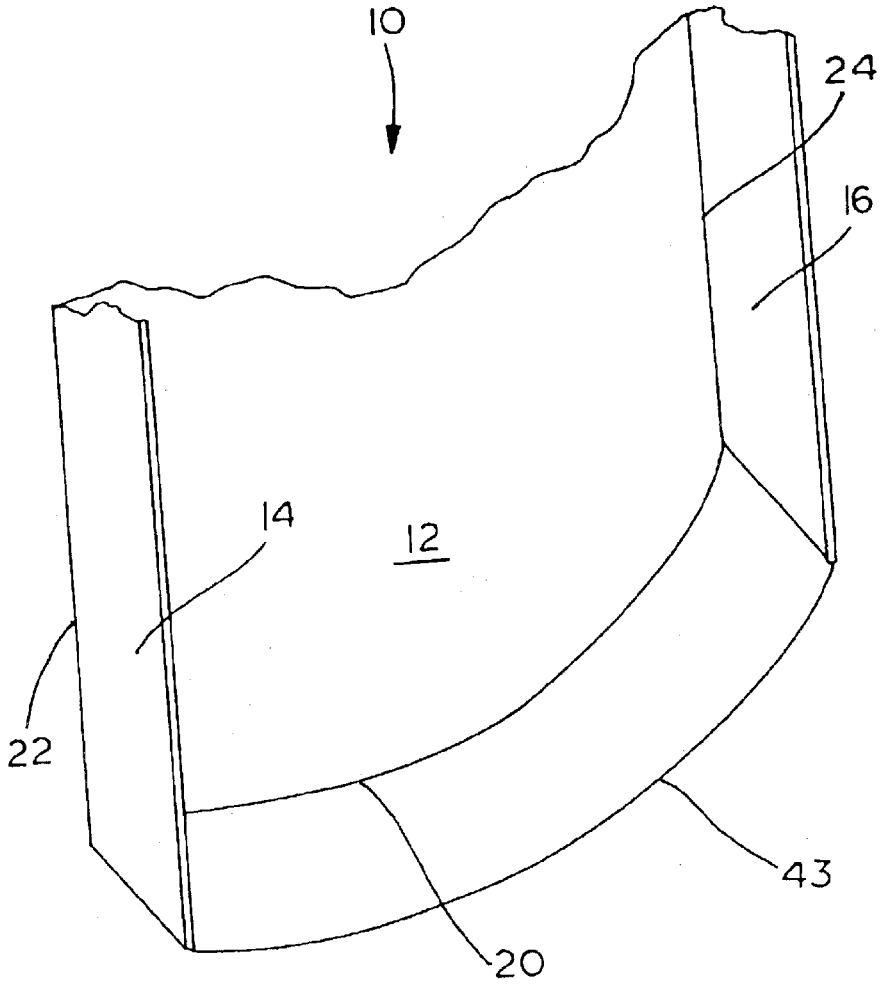
FIG. 3A is a fragmentary view in perspective of a rear side of the can caddie of FIG. 1 illustrating an optional rib extending across the width of the central section.
Figure 3B:
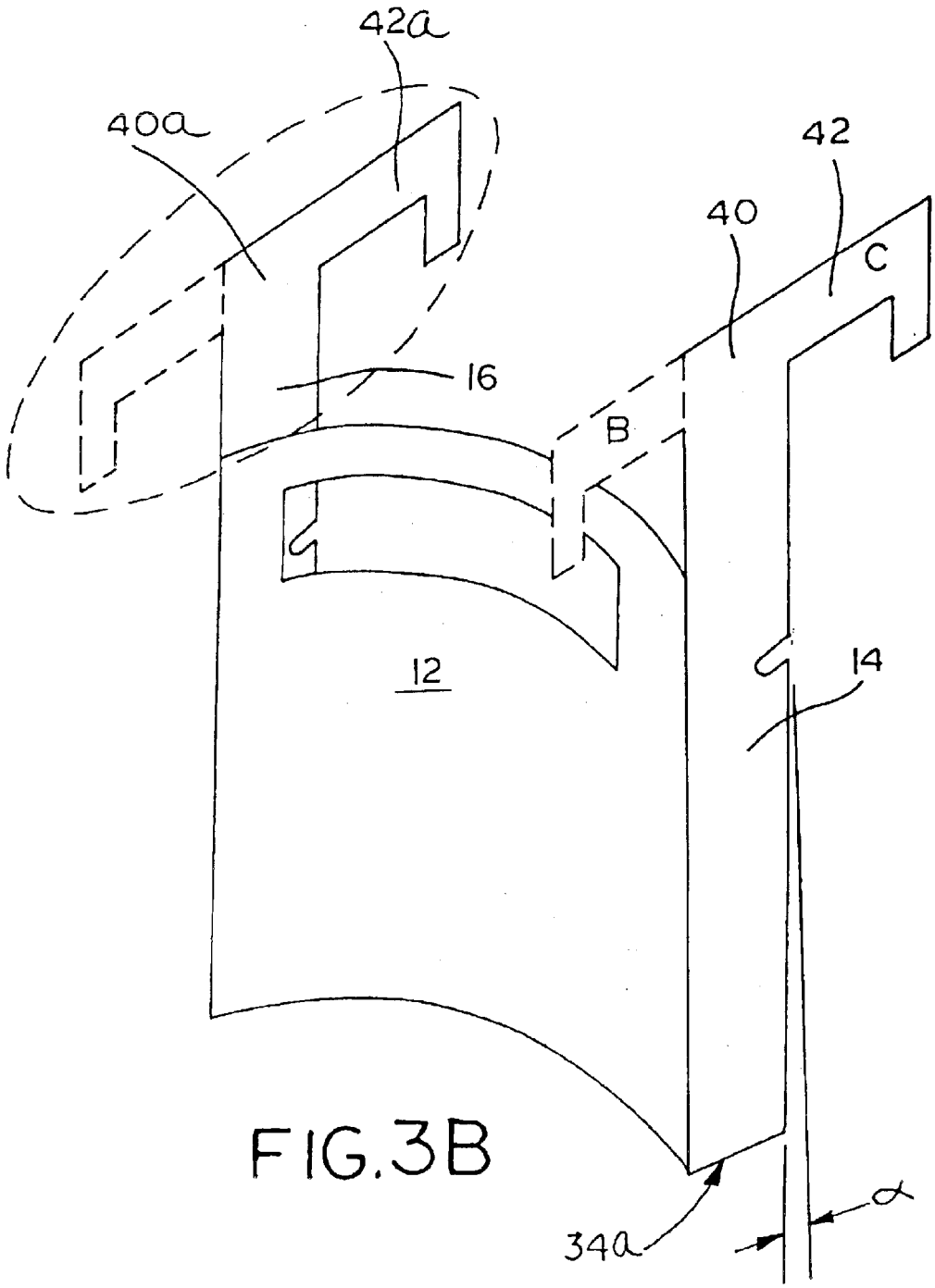
FIG. 3B is a front perspective view of a can caddie similar to that shown in FIG. 1 and illustrating an optional hook arrangement and an optional tapered side member.

Referring to FIG. 3B, the hooks 42, 42*a* on the upper portion 40, 40*a* of the side members 14, 16 may be arranged in alternative configurations (configuration C shown in solid lines in FIG. 3B or configuration B shown in dotted lines in FIG. 3B). For example, the hooks 42, 42*a* may be built in the configuration C wherein the hooks, 42, 42*a* face rearward from the central section 12. Alternatively, the hooks 42, 42*a* may be built in the configuration B wherein the hooks 42, 42*a* face forward and in the same direction as the curvature of the central section 12. Alternatively, the can caddy may be built with both configurations B, C incorporated. This can be accomplished by fixing (molding in) a pair of downward facing hooks in opposite directions of each other in the upper portion 40, 40*a* of the side members 14, 16.

Figure 10:
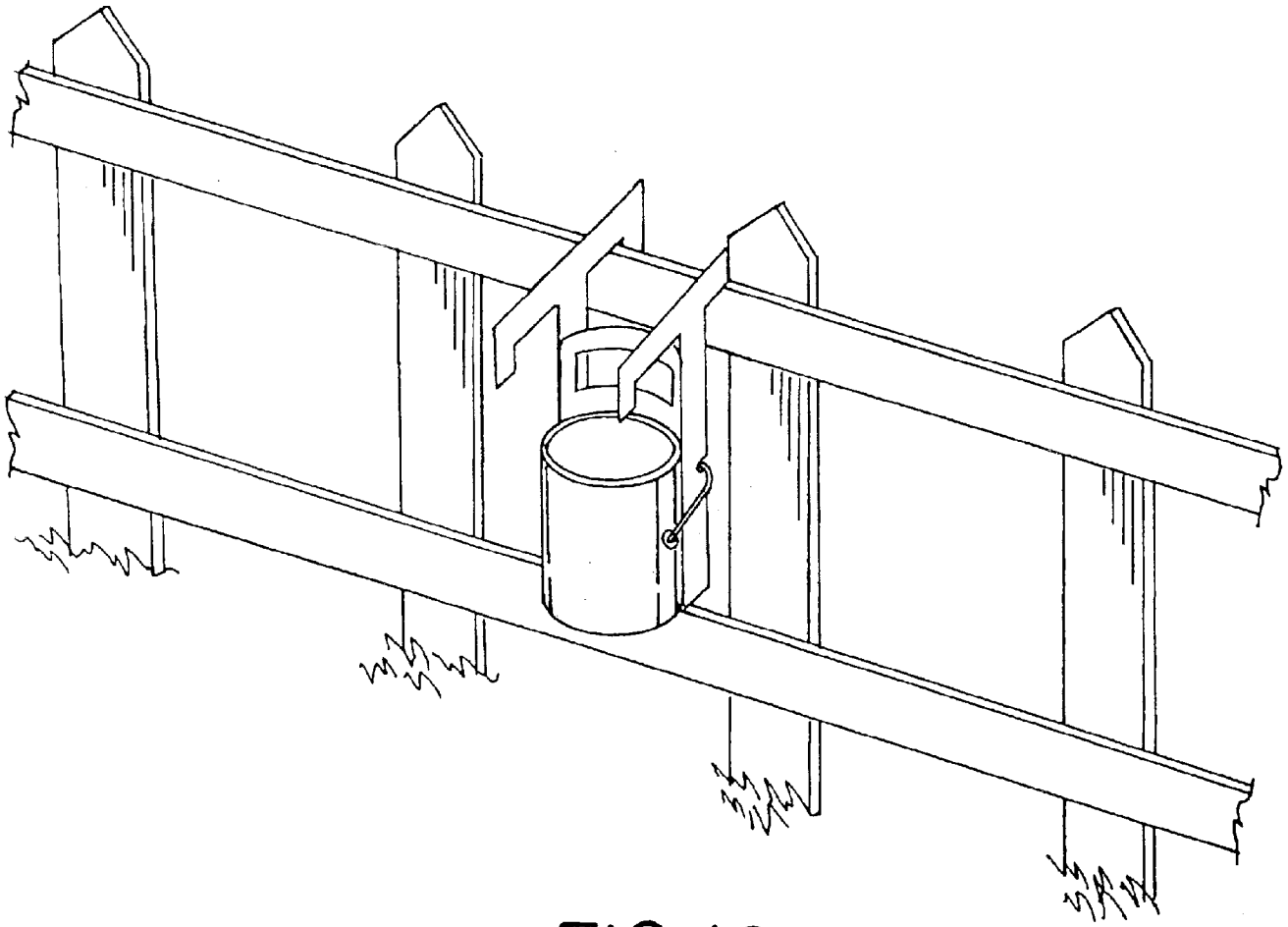
FIG. 10 is a perspective view of a can caddie similar to that shown in FIG. 3B shown attached to a fence.
Figure 11:
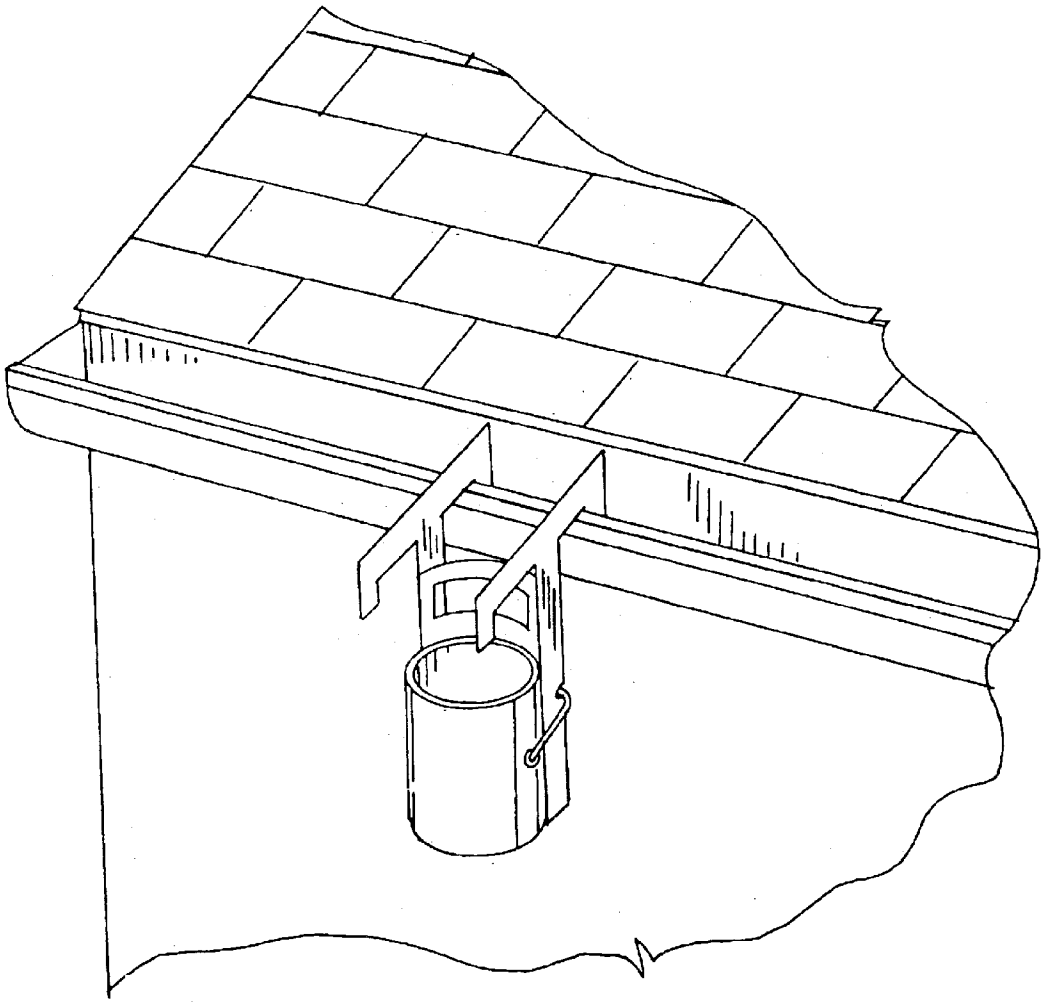
FIG. 11 is a perspective view of a can caddie similar to that shown in FIG. 3B shown attached to a gutter.

When constructed with either the forward and/or the rearward facing hooks 42, 42*a* of configurations B and C, the can caddy 10 may be suspended from various structures. Configuration C, for example, would accommodate suspending the can caddy 10 from a ladder 76 illustrated in FIGS. 4–6. Configuration B, for example, would accommodate suspending the can caddy 10 from various home structures such as fences (FIG. 10) or gutters (FIG. 11). These examples are illustrative only and are not meant to limit the scope of the invention to the applications shown.

Figure 3C:
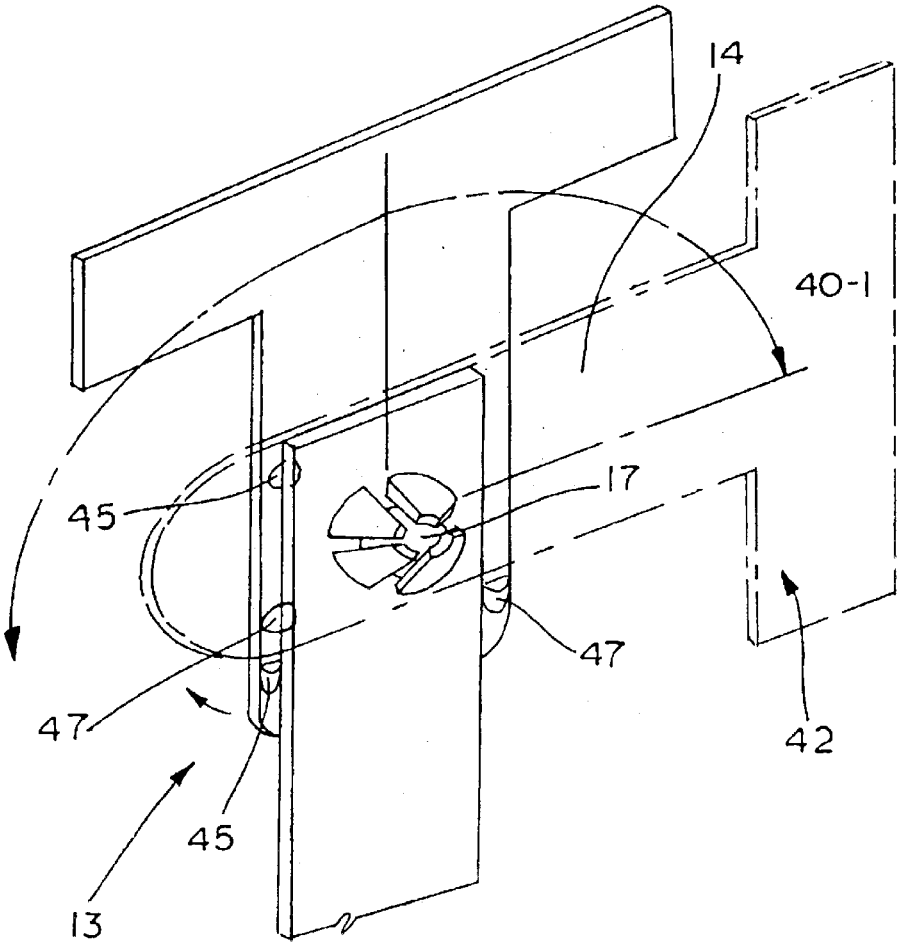
FIG. 3C is an enlarged fragmentary view in perspective of an optional adjustable hook structure.

Alternatively, the can caddy 10 may include a floating leg mechanism 13 that allows one or more of the hooks 42, 42*a* to rotate up to 180° between an upright position (shown in solid lines in FIG. 3C) and a shifted position (one of which is shown in dotted lines in FIG. 3C, the other shifted position being 180 degrees from dotted lines of FIG. 3C). In the example of FIG. 3C, the hook 42 includes an upper portion 40-1 which is joined to the side member 14 by a hinge or pivot 17. It will be understood that the side member 16 may include an identical structure. However, in the interest of brevity, only the alternative structure for the hook 40 will be discussed. The upper portion 40-1 includes two locking tabs 45 and 47. The locking tabs 45, 47 may be molded or otherwise formed so as to span the width of the side member 14 when the upper portion 40-1 is in the un-shifted position (solid lines) of FIG. 3C, and so that the locking tabs 45, 47 engage one of the side edges of the side member 14 when the upper portion 40-1 is in either one of the shifted or folded positions. As shown in FIG. 3*c*, a pivot pin 17 or other suitable structure is provided to permit the upper portion 40-1 to pivot 17 relative to the side member 14.

Thus, in the example of FIG. 3C, the hook 42 formed when the upper portion 40-1 is shifted to the folded positions may face forward or rearward, thus enabling a user to suspend the can caddy 10 from various structures as discussed above.

The upper portion 40*a* also includes a second hook 50*a* which generally extends from the side edge 36*a*. The second hook 50*a* includes a receiving area 52*a* which is defined at least in part by an edge 54*a* and a pair of legs 56*a*, 58*a*. It will be noted that the receiving area 52*a* of the second hook 50*a* is oriented in a generally upward direction. The side edge 36*a* of the side member 16 includes an angled notch 60*a* (FIGS. 2 and 3), which is preferably located at the same height as the notch 60 in the side edge 36 of the side member 14.

In the disclosed example, the side member 16 forms a generally planar panel 15*a*. The panel 15*a* is generally contiguous and runs between the pair of hooks 42, 42*a* in the upper portion 40*a* and the lower edge 34*a* at the bottom of the side member 16. The panel 15*a* is further bounded by the side edge 36*a*, the side edge 38*a* and the fold line 24.

As shown in each of FIGS. 1–6, the central section 12 of the can caddie 10 is generally curved. Accordingly, the central section 12 defines a concave curved surface 62 (shown in FIGS. 1 and 2–6) which forms a general receiving area 13, and also defines a convex curved surface 64 (shown in FIG. 3) on the opposite side of the can caddie 10. Alternatively, the central section 12 may be similarly shaped using a plurality of spaced and generally parallel fold lines (not shown).

Referring now to FIGS. 2 and 3, it will be noted that the curvature of the central section 12 is sized and shaped to generally match the curvature of a can 66. In a preferred application, the can 66 is a one gallon paint can of the type commonly available in the retail paint trade. It will be understood that the can caddie 10 can be formed in a variety of sizes so as to receive and hold a variety of other commercially available paint can sizes (not shown). The paint can 66 includes a wire handle 68 which pivots about a pair of pivots 70 as is known in the art and also includes a sidewall 71 having a curved outer surface 72. As shown, the paint can 66 may be positioned such that the outer surface 72 of the paint can 66 is disposed against the concave curved surface 62 of the central section 12. As outlined above, because the curvature of the central section 12 generally conforms to the curvature of the outer surface 72 of the paint can 66, the paint can 66 and the central section 12 will meet along a generally curved interface 74. The wire handle 68 is received in the angled notches 60, such that the paint can 66 will be secured in place attached to the can caddie 10 aided by the force of gravity. It will be noted that when the can 66 is in the receiving area 13, only the sidewall 71 of the can 66 engages the can caddie 10 (except for contact between the wire handle 30 and the notches 60, 60*a*). It will be understood that the can 66 also may include top and bottom rims, which for purposes of this discussion may be referred to as part of the sidewall.

A separate support disposed underneath the bottom of the can 66 is not required. It will be appreciated that, depending on the shape of the central section 12, the receiving area 13 may contact the outer surface 72 of the paint can 66 along a generally curved interface, or, at a number of discrete points spaced about a portion of the circumference of the paint can 66.

Alternatively, the side members 14, 16 may be tapered at an angle $\alpha$ (FIG. 3B) from the upper portion 40, 40*a* to the lower edge 34, 34*a* of the side members 40, 40*a*. This angled configuration may, in the disclosed example, ease the placement of the central section 12 between the paint can 66 and the wire handle 68.

As shown in FIG. 3A, the can caddy 10 may include an optional base or rib 43 that extends between the side members 14, 16, essentially extending between the pair of fold lines 22, 24 and being joined to the bottom edge 20 of the central section 12. In the disclosed example of FIG. 3A, the rib 43 may provide additional strength or additional stability to the can caddy 10 in the event the can caddy 10 is placed on a flat support surface.

Figure 4:
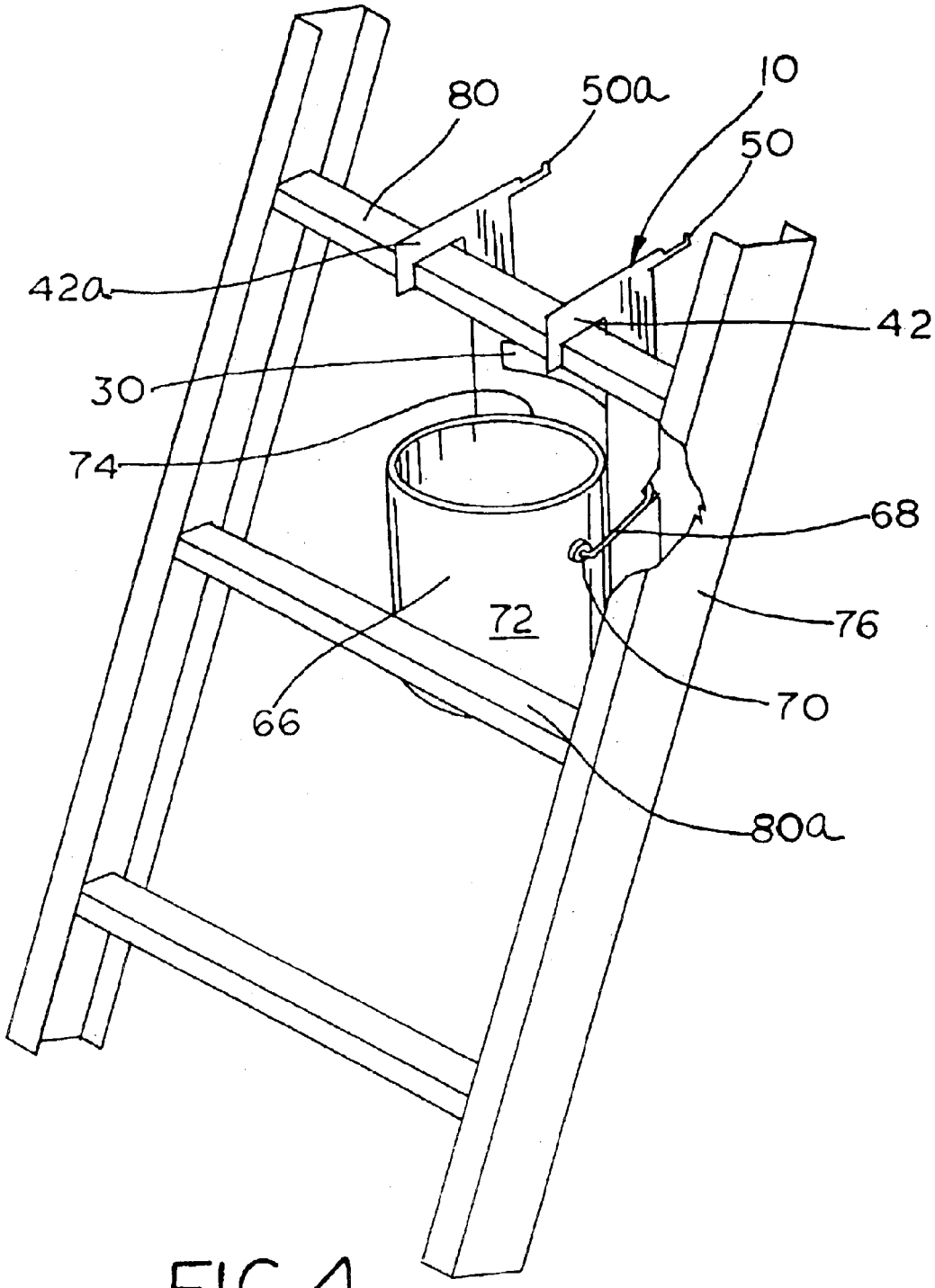
FIG. 4 is a perspective view of the can caddie of FIGS. 1–3 shown attached to a ladder.
Figure 5:
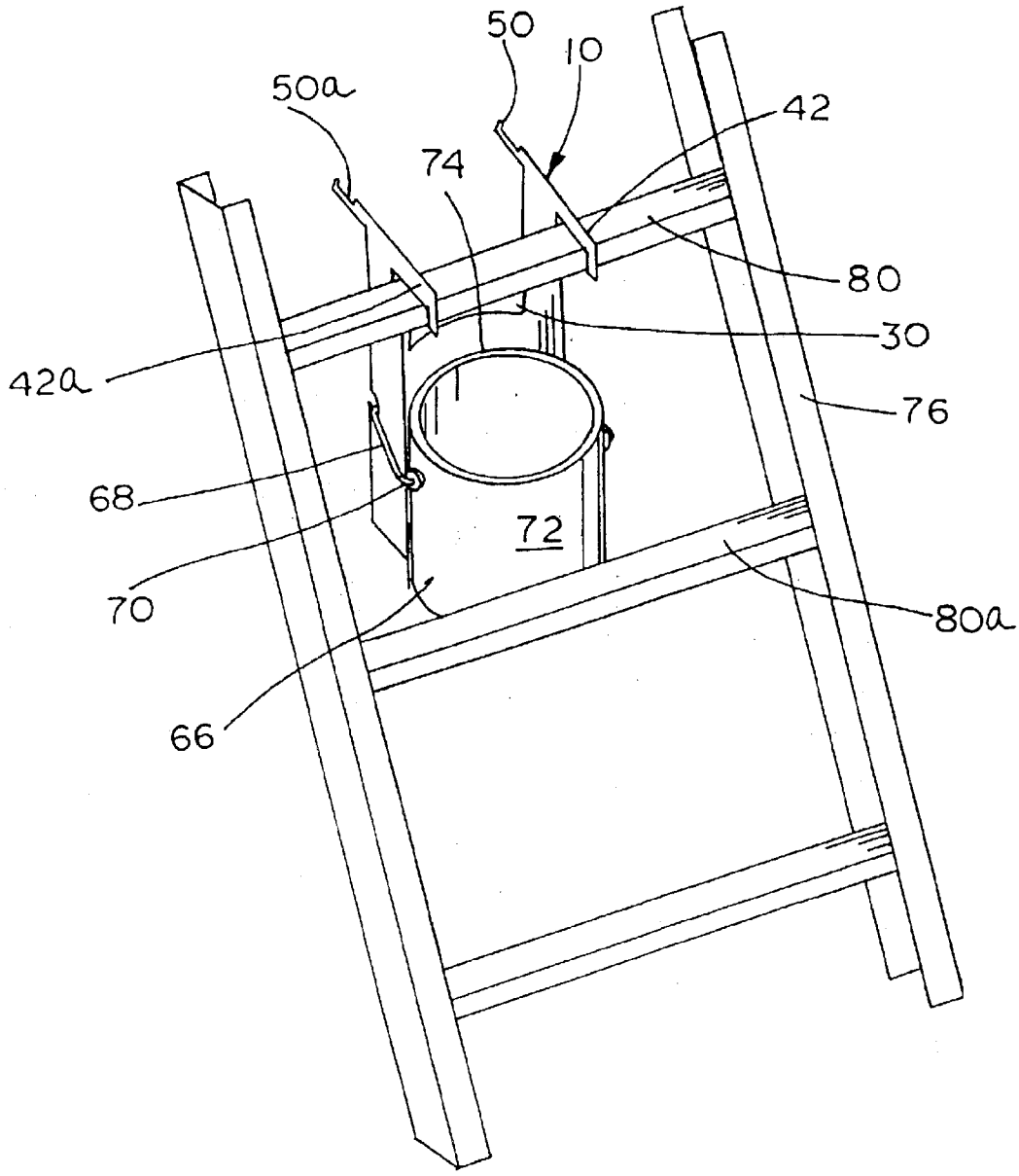
FIG. 5 is another perspective view of the can caddie attached to a ladder.
Figure 6:
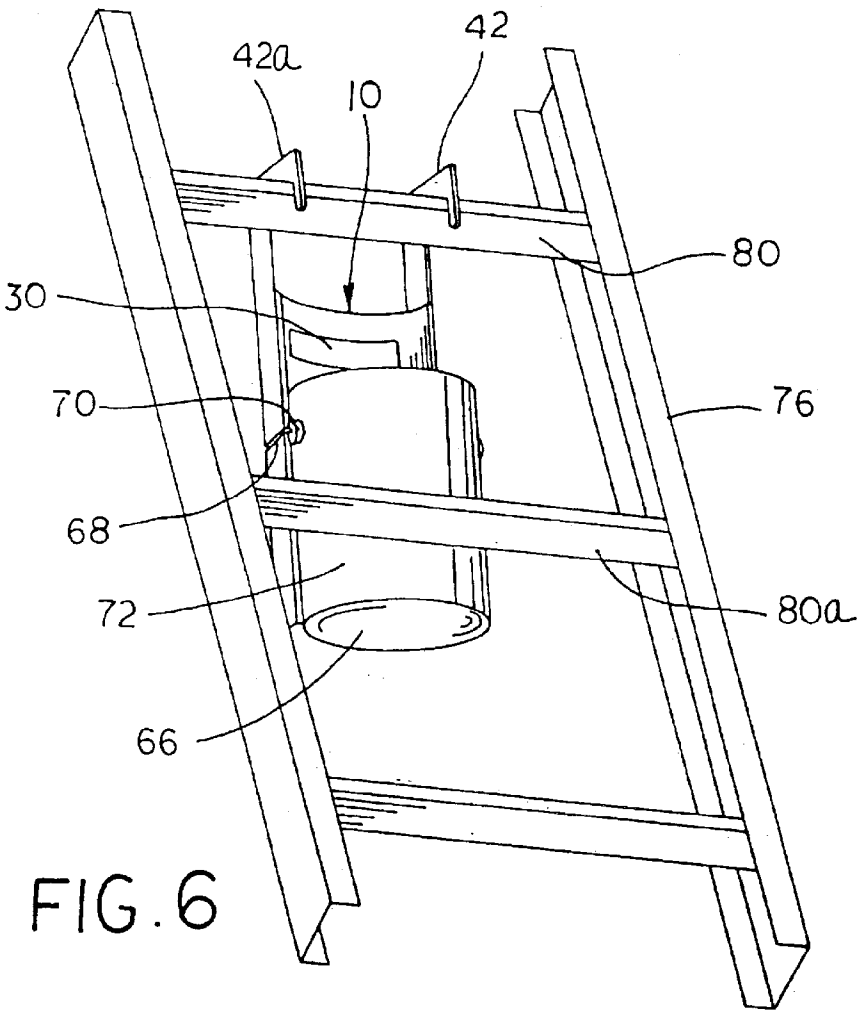
FIG. 6 is yet another perspective view of the can caddie attached to a ladder.

In the disclosed embodiment, the can caddie 10 is a useful device to facilitate painting tasks performed at heights that require using a ladder, such as the ladder 76 illustrated in FIGS. 4–6. The can caddie 10 thus forms a support for the paint can 66, as well as for brushes and other tools (not shown) in such a manner that they hang from the can caddie 10 in close proximity to the ladder 76. The frame has a channel-shaped cross-section with a concave web.

In the disclosed embodiment, the can caddie 10 includes a longitudinal axis 78 (FIGS. 1–3) that is generally parallel to an axis 80 (FIGS. 2 and 3) of the can 66. It will be noted that the can caddie 10 is longer than the height of a standard paint can 66. Also, in the disclosed embodiment the side edges 36, 36*a* of the side members 14, 16 are oriented to face away from the can 66.

As shown in FIGS. 3–6, the hooks 48, 48*a* which protrude from the upper portion 40, 40*a* of the side members 14, 16 engage a selected rung 80 of the ladder 76, and thus secure the can caddie 10 to the ladder 76. A third hook, foot, or other protrusion (FIG. 13) may protrude from the bottom of the central section 12, or from the bottom portion of the side member 14 and/or 16, with the purpose of steadying the can caddie 10 to the next lower rung 80*a* of the ladder 76.

It will be noted that the receiving areas 52, 52*a* of the hooks 50, 50*a* provide a convenient place for hanging paint brushes or other useful tools from the can caddie 10.

In operation, the can caddie 10 is used by sliding the can caddie 10 between the body of the paint can 66 and the wire handle 68. The handle 68 is positioned such that it engages both notches 60, 60*a* in the side members 14, 16. Lowering the paint can 66 or lifting on the can caddie 10 locks the can 66 to the can caddie 10. The can caddie 10 may be carried using the oblong handle 30 formed at least in part by the cutout 26 and the cross member 28.

The can caddie 10 may be fabricated from a variety of materials including plastic, composites, or formed metal to name several examples. The can caddie 10 may be formed using any one of a number of suitable forming techniques, such as thermo-forming, blow-molding, vacuum forming, or injection molding (in the event the can caddie 10 is manufactured of a plastic or other suitable material). The can caddie 10 may alternatively be stamped and formed from a suitable gauge of sheet metal. Presently, injection molding may be preferred. Any of the above methods may be used to form the can caddie 10 as an integral or one-piece unit. Alternatively, the can caddie 10 may be assembled from a number of component parts.

In accordance with the disclosed example, a number of features and variations may be contemplated. The following examples are illustrative only and in no way are intended to limit the scope of the invention to the exemplary details discussed. These illustrative examples include:

1) The number and type of hooks and or protrusions used may vary from the configurations described above. The continuous top hook or a continuous bottom foot may be used, or a different number of top hooks and/or bottom feet may be employed. Further, one, two, or all hooks and/or protrusions or feet may be hooked or suitably secured to the ladder rung(s) to prevent spontaneous or unintentional disengagement from the ladder rung.
2) The number, configuration, and location of hooks for supporting paint-brushes may vary.
3) The can caddie 10 may be configured such that it provides a foot or feet for hanging free from the ladder rung without being supported or steadied by a lower foot or protrusion. There may also be the option of providing support through the use of a swinging or movable foot. This foot could be mounted via a post or rung from the bottom of the can caddie. The foot could be swung out of the way to allow the fixture to freely hang from the upper rung, or, alternatively, such a foot could be hooked onto the rung to steady the can caddie.
4) The can caddie 10 is not limited to painting tasks. The can caddie 10 may be used in conjunction with an empty can to carry and support any tools (e.g. scrapers, additional brushes, rollers, hammers, or other useful tools) that may be required when working at elevation from an extension ladder.

In forming the can caddie 10 is formed, preferably by injection molding. Alternatively, a blank 82 following the outline shown in FIG. 6 may be formed from a continuous sheet of suitable material, such as a sheet of polyethylene. The blank 82 may be stamped or otherwise suitably cut from the sheet of material. It will be understood that, in such an example, the blank 82 would start out as generally planar. Using a suitable forming or stamping process, the concave and convex curved surfaces 62, 64 are formed. The side members 14, 16 are bent along their respective fold lines 22, 24, to the desired orientation. It will be understood that the term "fold line" is used for ease of reference. The formation of the fold lines 22, 24 can encompass any suitable process wherein the fold lines are formed or molded with the side members 14, 16 and does not necessary mean the folded lines were created by a "folding" process. In the disclosed embodiment, the side member 14 and the side member 16 are generally parallel to each other after folding along their respective fold lines 22, 24. Alternatively, the side members 14 and 16 may be angled slightly relative to each other, thus permitting a number of identical can caddies 10 to be placed on a surface and stacked on top of each other.

Figure 7:
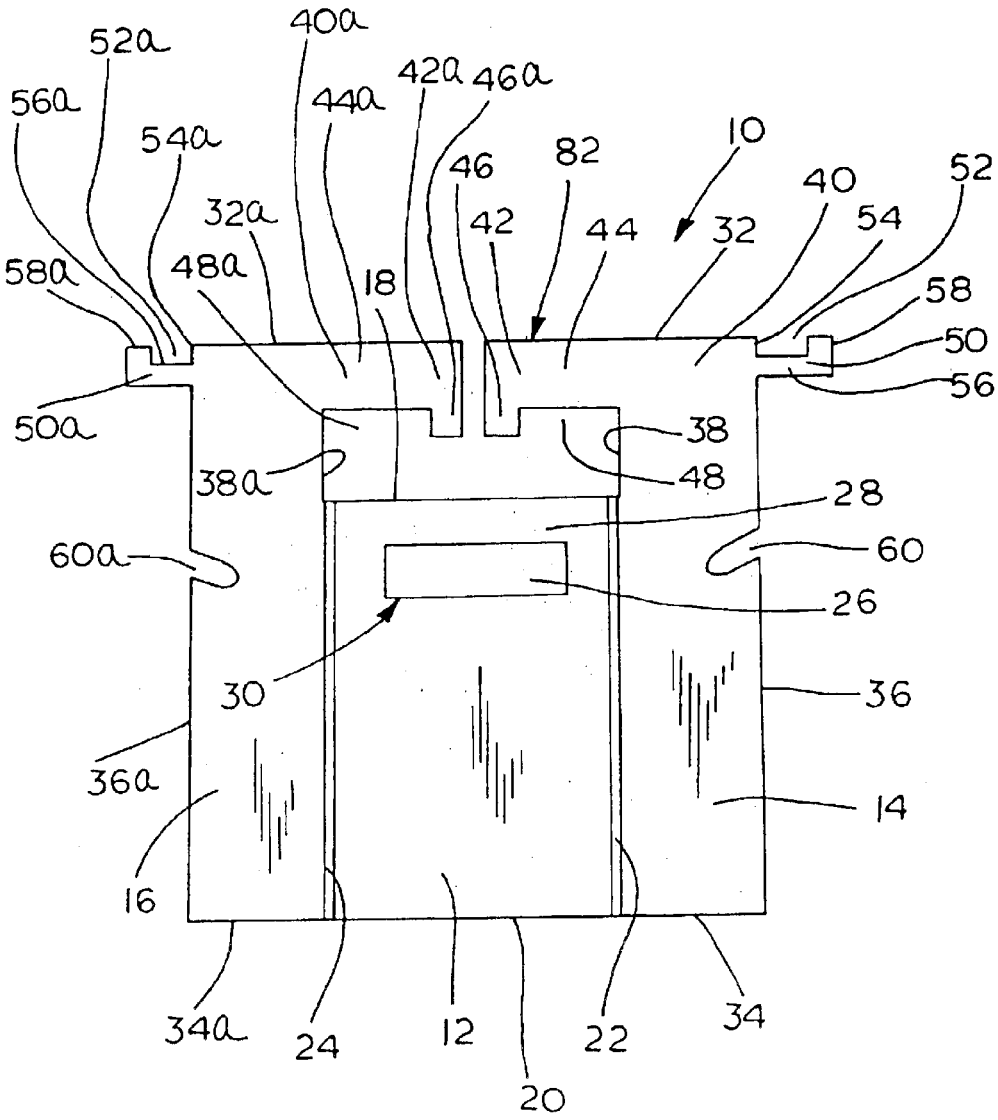
FIG. 7 is a top plan view of a formed blank of material prior to formation into the can caddie illustrated in FIGS. 1–6.

Prior to folding the outlines of the hooks 42, 42*a*, 50, 50*a*, the notches 60, 60*a*, and the handle 30, are all formed in the blank 82. Consequently, after folding along the fold lines 22, 24, no further fabrication may be required. The can caddie 10 according to the disclosed embodiment is thus relatively quick and cost effective to fabricate, and may be formed in as few as two steps 1) shaping the blank 82 by stamping so that the blank 82 has the outline shown in FIG. 7; and 2) forming the blank 82 into the can caddie 10 to take the shape of FIGS. 1–6.

Figure 8:
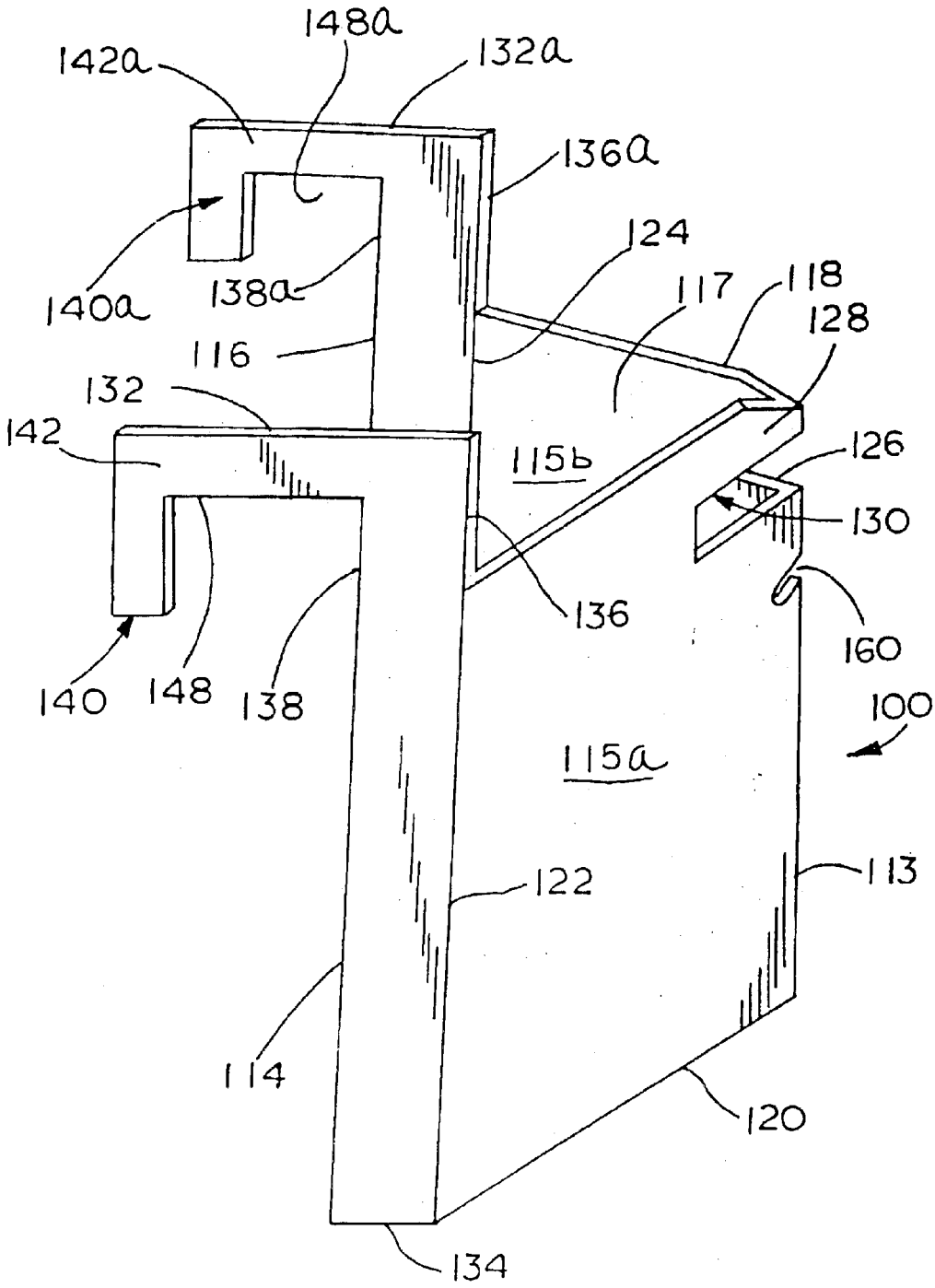
FIG. 8 is a perspective view from above of a can caddie assembled in accordance with the teachings of a second disclosed embodiment of the invention.

Referring now to FIG. 8 of the drawings, a can caddie assembled in accordance with the teachings of a second disclosed embodiment of the invention is generally referred to by the reference numeral 100. The can caddie 100 includes a central section 112 and a pair of side members 114, 116. The central section 112 includes a top edge 118, a bottom edge 120, and is generally bounded by a pair of fold lines 122, 124. The side members 114 and 116 are generally parallel to each other. It will be noted that the side member 114 generally meets the central section 112 at the fold line 122, while the side members 116 generally meets the central section 112 along the fold line 124. The central section 112 also includes a cutout 126 which extends generally parallel to the top edge 118, and which is separated from the top edge 118 by a cross member 128, such that the cutout 126 and the cross member 128 cooperate to form a handle 130.

The side member 114 includes an upper edge 132, a lower edge 134 and a side edge 136, with the side edge 136 preferably extending generally parallel to the fold line 122. The side member 114 also includes a side edge 138 which extends generally parallel to the side edge 136, with the edge 138 generally extending upwardly from the fold line 122. Thus, the side edge 138 is generally parallel to and across from an upper portion of the side edge 136. The side member 114 includes an upper portion 140 defining a hook 142. The hook 142 includes a receiving area 148 that faces in a generally downward direction when the can caddie 110 is oriented as shown, so as to engage a ladder rung (not shown).

Similarly, the side member 116 includes an upper edge 132*a*, a lower edge 134*a* (obscured in FIG. 8), and a side edge 136*a*, with the side edge 136*a* preferably extending generally parallel to the fold line 124. The side member 116 also includes a side edge 138*a* which extends generally parallel to the side edge 136*a*, with the side edge 138*a* generally extending upwardly from the fold line 124. Thus, the side edge 138*a* is generally parallel to and across from an upper portion of the side edge 136*a*. The side member 116 includes an upper portion 140*a*. The upper portion 140*a* includes a hook 142*a* having a downwardly oriented receiving area 148*a*.

The central section 112 of the can caddie 110 includes a fold line 113, which divides the central section 112 into a pair of panels 115*a*, 115*b*. The fold line 113 includes an angled notch 160 which extends partially onto both of the panels 115*a* and 115*b*. The panels 115*a*, 115*b* cooperate to form a receiving area 117 which faces generally to the left when viewing FIG. 8 and which is sized to receive a can therein in a manner similar to that discussed above with respect to the first disclosed embodiment. It will be appreciated that, depending on the shape of the central section 112, the receiving area 117 may contact the outer surface 72 of the paint can 66 along a generally curved interface, or, at a number of discrete points spaced about a portion of the circumference of the paint can 66.

Figure 9:
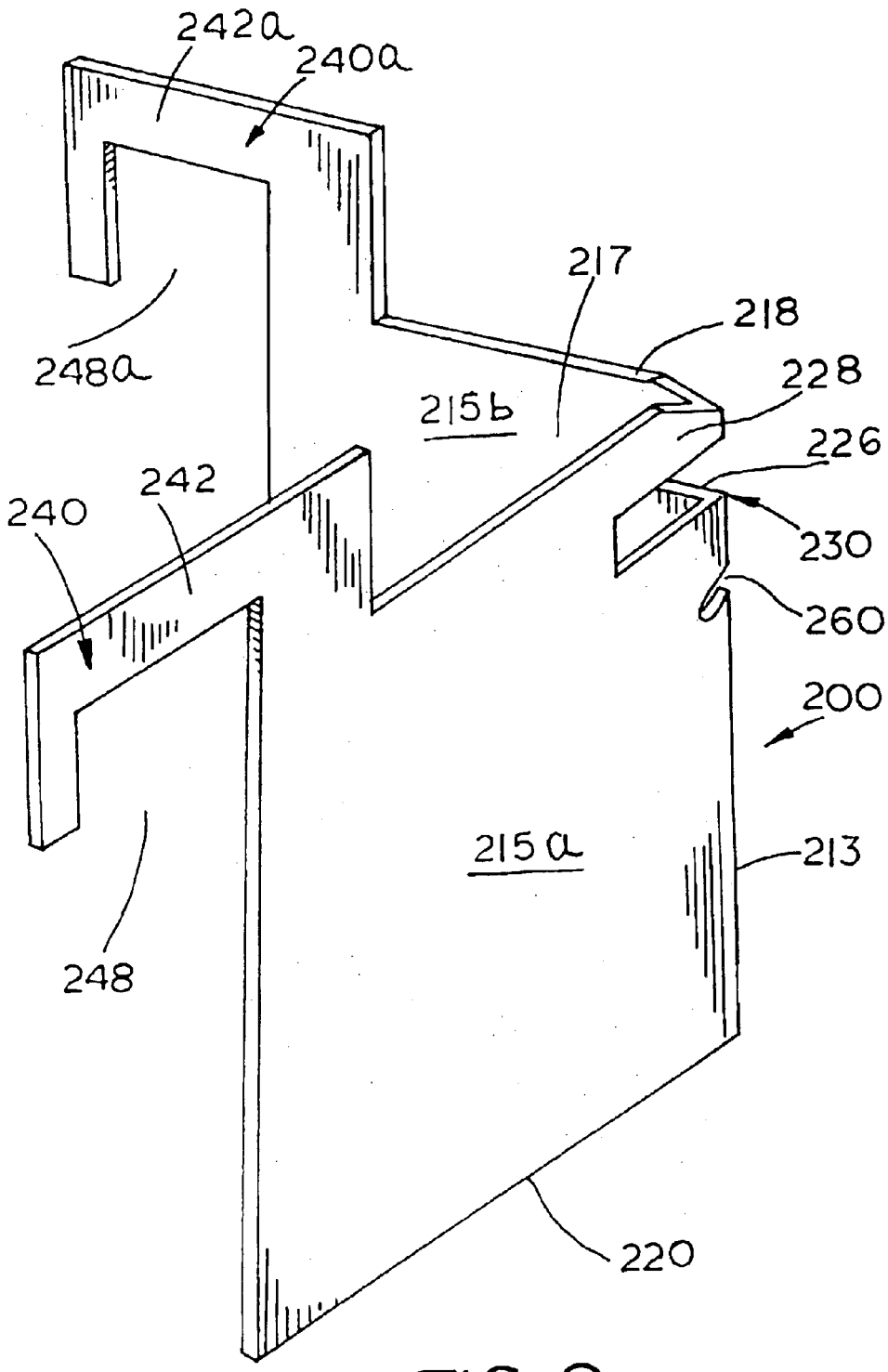
FIG. 9 is a perspective view from above of a can caddie assembled in accordance with the teachings of a third disclosed embodiment of the invention.

Referring now to FIG. 9 of the drawings, a can caddie assembled in accordance with the teachings of a second disclosed embodiment of the invention is generally referred to by the reference numeral 200. The can caddie 200 is substantially similar in all respects to the can caddie 100, with the exception that the fold lines 122, 124 of the second embodiment are eliminated, such that the side members 214, 216 lie in substantially the same plane with the panels 215*a*, 215*b*. The can caddie 200 is similar in all other respects to the embodiment of FIG. 8, and thus like elements are labeled with the same reference characters, although the reference characters have been increased by 100.

Figure 12:
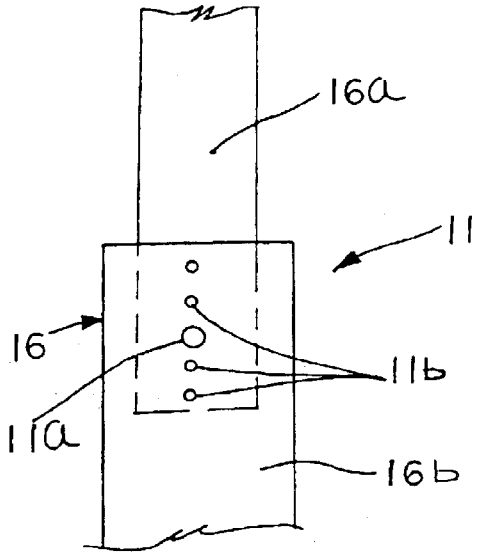
FIG. 12 is an enlarged fragmentary elevational view illustrating an optional length adjustment mechanism for use with the side members of the can caddie.

FIG. 12 illustrates an optional length adjustment mechanism 11 for use with either of the side members 14 or 16. In the example shown, the side member 16 is divided into an upper section 16*a* and a lower section 16*b*, and an adjustable pin mechanism 11*a* which engages one of a plurality of holes 11*b* permits the overall length of the side member 16 to be adjusted.

Figure 13:
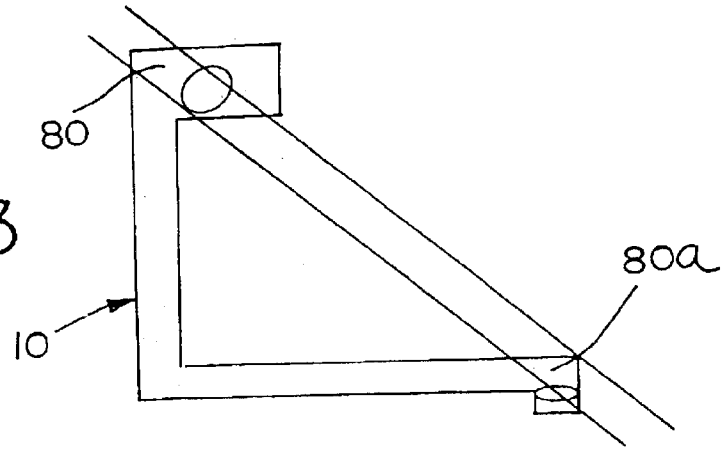
FIG. 13 is a side elevational view of a can caddie incorporating an optional third leg or brace sized to engage a lower rung of a ladder.
Figure 14:
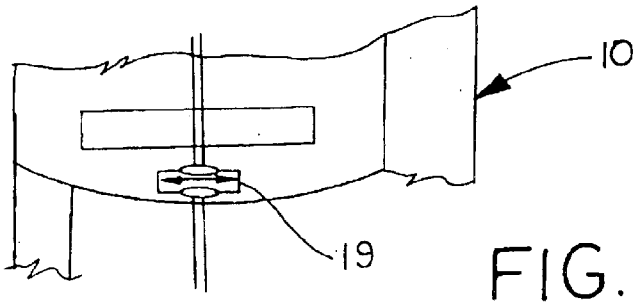
FIG. 14 is an enlarged fragmentary view in perspective of an optional hose clamp for clamping the hose of a spray painting implement.

FIG. 13 illustrates the can caddie 10 equipped with an optional hose clamp 19. The hose clamp 19 may be attached to, for example, the central section 12, and may be sized to engage a hose from a spray painting implement (not shown).

Those skilled in the art will appreciate that, although the teachings of the invention have been illustrated in connection with certain embodiments, there is no intent to limit the scope of this patent to such embodiments. On the contrary, the intention of this patent is to cover all modifications and embodiments fairly falling within the scope of the claimed invention either literally or under the doctrine of equivalents.

What is claimed is:

1. A device for supporting a container on a support structure, the container having a wire handle and a curved sidewall, the device comprising:

a pair of spaced apart side members, each of the side members having an upper portion adapted to engage the support structure, each of the side members further having a notch sized to receive the wire handle;

a central portion disposed between the side members, the central portion defining a receiving area sized and shaped to receive the container, the receiving area further sized and shaped to engage only the sidewall of the container along an elongate and longitudinally extending curved interface; and wherein the notch of each of the side members and the curved interface are arranged such that the container is supportable exclusively by the notches and the curved interface.

2. The device of claim 1, wherein each notch is angled.

3. The device of claim 1, wherein each of the side members includes an edge, each notch formed in a corresponding edge.

4. The device of claim 3, wherein each side member is separated from the central portion by a fold line, and wherein the edge of each side member is spaced away from its corresponding fold line.

5. The device of claim 1, wherein each of the side members further comprises a panel, each panel connected to the central portion along a fold line and extending away from the central receiving area.

6. The device of claim 5, wherein the notch of each of the side members is formed in an edge portion of the panel.

7. The device of claim 1, wherein the upper portion of each of the side members includes a downwardly facing hook.

8. The device of claim 7, each of the hooks further having a pair of legs, the pair of legs cooperating to define a receiving area sized and shaped to receive the support structure.

9. The device of claim 7, wherein the upper portion of at least one of the side members includes an upwardly facing hook.

10. The device of claim 9, wherein the second hook is spaced away from the downwardly facing hooks and includes a pair of legs, the legs defining a receiving area.

11. The device of claim 1, wherein the central portion includes a top edge and a cutout extending parallel to the top edge, the cutout separated from the top edge by a cross member, the cross member and the cutout cooperating to form a handle.

12. The device of claim 11, wherein the cutout is spaced a first distance from the top edge, the notches located on the side members such that a top portion of the container is disposed a second distance greater than the first distance from the top edge when the container is in the receiving area such that the handle is exposed.

13. The device of claim 1, the central portion having a concave curved surface such that the receiving area is shaped to engage at least a portion of the curved sidewall of the container.

14. The device of claim 1, wherein the support structure is a ladder having at least one rung, and wherein the upper portion of each side member forms a hook sized to engage the rung.

15. A device for supporting a container on a support structure, the container having a wire handle and a curved sidewall, the device comprising:

a pair of spaced apart side members, each of the side members having an upper portion adapted to engage the support structure, each of the side members further having a front edge and a rear edge, the rear edge of each of the side members having a notch sized to receive the wire handle, each of the side members further having at least one hook sized to engage the support structure; and a longitudinally extending central portion disposed between the side members, the central portion defining a generally concave receiving area sized and shaped to receive the container, the central portion meeting each of the side members along a longitudinally extending interface defined at least in part by the front edge of the side members, the central portion further having a handle, the handle sized to be accessible when a container is placed in the receiving area.

16. A device for supporting a container having a sidewall and a curved wire handle on a support structure, the device comprising:

a central panel, the central panel shaped to receive a portion of the sidewall of the container along an elongate longitudinally extending receiving surface; and a pair of side members joined to opposite sides of the central panel and separated from the central panel by an elongate and generally linear interface, each of the side members having a notch sized to receive the curved wire handle of the container, each of the side members further having a pair of downward facing hooks sized to engage the support structure;

the receiving surface and the notches arranged so that upon placement of the container in the receiving area with the wire handle disposed in the notches the container is supported exclusively by contact between the wire handle and the notches and by contact between the sidewall and the receiving surface.

17. The device of claim 16, each of the side members including length adjustment means for adjusting the length of the side members.

18. The device of claim 16, wherein each of the side members include means for changing the orientation of the hooks.

19. The device of claim 16, each of the side members further comprising a brace, the brace sized to engage a lower portion of the support structure.

20. A device for supporting a container on a support structure, the container having curved sidewall and a handle formed in part by a curved wire, the device comprising:

a pair of spaced apart side panels, each of the side panels having an upper portion adapted to engage the support structure, each of the side panels further having a front edge and a rear edge;

an angled notch disposed on the rear edge of each of the side panels, each notch sized to receive a portion of the curved wire; and a longitudinally extending central panel disposed between the side panels, the central panel extending between the front edges of each of the side panels and meeting each front edge along a longitudinally extending line, the central panel having a front side, the front side sized and shaped to define a longitudinally extending receiving area arranged to receive the container along an elongate interface.

21. The device of claim 20, wherein the central panel is generally concave toward the front side.

22. The device of claim 20, wherein the central panel includes a handle formed at least in part by an aperture in the central panel.

* * * * *